US005582335A

United States Patent [19]

Beard et al.

[11] Patent Number: 5,582,335

[45] Date of Patent: Dec. 10, 1996

[54] BABY BOTTLE SUPPORT

[76] Inventors: Mark D. Beard; Deborah A. Beard, both of P.O. Box 602, Gypsum, Colo. 81637

[21] Appl. No.: 254,907

[22] Filed: Jun. 6, 1994

[51] Int. Cl.[6] ..... A61J 9/06

[52] U.S. Cl. ..... 224/148.5; 224/602; 224/148.7; 248/102

[58] Field of Search ..... 224/148, 205, 224/602; 248/102; 215/11.6

[56] References Cited

U.S. PATENT DOCUMENTS

| | | | |
|---|---|---|---|
| 2,362,020 | 11/1944 | Morrow | 248/102 |
| 2,494,632 | 1/1950 | Rodin | 224/148 X |
| 2,617,105 | 11/1952 | Backman | 224/148 X |
| 2,644,623 | 7/1953 | White | 224/148 |
| 2,924,413 | 2/1960 | Mahoney | 224/148 |
| 3,065,944 | 11/1962 | Liebendorfer | 248/102 |
| 3,144,230 | 8/1964 | Brooks . | |
| 3,977,638 | 8/1976 | Woodard | 248/102 |
| 4,220,302 | 9/1980 | Hampton et al. | 248/102 |
| 4,537,341 | 8/1985 | Kelly | 224/148 X |
| 4,718,623 | 1/1988 | McClure | 248/102 |
| 5,397,039 | 3/1995 | Parcelles | 224/148 |

*Primary Examiner*—Renee S. Luebke

*Attorney, Agent, or Firm*—Donald W. Margolis; Emery L. Tracy

[57] ABSTRACT

A nursing baby bottle holder for supporting a baby bottle in a nursing position is provided. The baby bottle has a body portion and a neck portion. The holder comprises a length of material defining an annular open end to releasably secure the body portion of the baby bottle. The length is sufficient to drape the material around a neck of a user while supporting the baby bottle in a nursing position.

10 Claims, 2 Drawing Sheets

BABY BOTTLE SUPPORT

BACKGROUND OF THE INVENTION a.) Field of the Invention

The present invention relates to baby bottle supports. More particularly, it relates to baby bottle supports which are drapable about the neck of a person holding an infant, and which can releasably position a baby bottle in a nursing position for the infant being held. It also relates to such baby bottle supports which may be used to hold other baby accessories.

b.) Discussion of the Prior Art

In nursing an infant with a baby bottle, it is conventional for a person, to hold an infant in one arm and to support the nursing baby bottle with the hand of the other arm. In the prior art, there have been many different types of baby bottle holders which support a baby bottle in a nursing position. Some of these baby bottle holders have been devised to hold baby bottles in a manner that will minimize the attention required by the person feeding the infant during the feeding process. Under the foregoing circumstances, in order to free at least one hand of the person many prior art baby bottle holders have been devised which include flexible or rigidly formed encircling members adapted to extend around the neck or to be suspended from one shoulder of the person holding the infant. Such baby bottle holders, for example, as described in Mahoney U.S. Pat. 2,924,413; Liebendorfer U.S. Pat. 3,065,944 and McClure U.S. Pat. 4,718,623, involve various devices which encircle or otherwise engage a baby bottle in a depending relationship from the encircling member.

Additionally, some prior art baby bottle holders have been devised to support a baby bottle in various positions adjacent to the infant who is to consume the contents of the baby bottle. For example, many types of such baby bottle supporting devices have been devised to be supported upon a pillow which is placed adjacent to a reclining infant. Other devices have been designed to be suspended from transverse straps and elongated members extending between the opposite sides of a crib or other support mechanism.

None of these prior art baby bottle supports provide a baby bottle holder which can be used by a person holding an infant in one arm to support a baby bottle in a depending manner from the neck of such a person while freeing the other arm and hand of such a person.

SUMMARY OF THE INVENTION

Therefore, it is an object of the present invention to provide a baby bottle holder which can be used by a person holding an infant in one arm, which baby bottle holder serves to support a baby bottle in a depending manner from the neck of such a person, while freeing the other arm and hand of such a person.

It is a further object of the present invention to provide such a baby bottle holder which has easily adjustable dimensions, thereby allowing it to be adjusted to fit an assortment of persons of different sizes who may hold and feed an infant.

It is yet a further object of the present invention to provide a baby bottle holder formed from a length of material which can be draped around the neck of a person who is holding an infant while releasably securing a baby bottle in a nursing position.

It is still yet a further object of the present invention to provide a kit which includes the baby bottle holder of the present invention, a baby accessory, such as a rattle or pacifier, and a clip for use in fastening the baby bottle holder to a piece of furniture.

The present invention relates to a baby bottle holder for supporting a baby bottle in a nursing position. The baby bottle holder of the present invention comprises a length of material having a first end and a second end. The first end defines an annular open end which is sized and designed to releasably receive and secure the body portion of a baby bottle. The length is sufficient to drape the material around the neck of a user while supporting the baby bottle in a nursing position.

In one preferred embodiment, the length of material is comprised of a flexible tubular member terminating at the first end in a resilient annular open portion which is sized to releasably receive and secure the body portion of a baby bottle within the tubular member. The tubular member is of a length which is sufficient to be draped around the neck of the largest potential user for use in supporting and locating a baby bottle in a nursing position for an infant held in one arm of that user. In preferred embodiments the flexible tubular member is seamless and is composed of or includes an expandable material, for example a stretchable polymer, such as a cotton-Lycra polymer blend material.

To position the baby bottle to the proper nursing location and height, the effective dimension of the length of material can be adjusted using the baby bottle support of the present invention. For example, a baby bottle may be raised, i.e. the effective length of the holder may be diminished, by bunching a portion of the length of material about the body of the baby bottle. Similarly, a baby bottle may be lowered, i.e. the effective length of the holder may be extended, by removing a portion of the length of material which has been previously bunched about the body of the baby bottle.

In preferred embodiments a support element for holding the neck of a baby bottle is connected to the second end of the length of material. The support element may include a strap having a mounting end which is mounted to the second end of the length of material, and an attaching end which is releasably attached to the second end of the length of material. As detailed below, the end strap may be used to support a baby bottle by encircling at least a portion of the neck of the baby bottle. In other embodiments, the end strap may be used to carry a baby accessory.

The present invention also teaches a kit which includes the baby bottle holder of the present invention, a baby accessory, such as a rattle or pacifier, and a clip for use in fastening the baby bottle holder to a piece of furniture.

The present invention also teaches a method of supporting a baby bottle from a neck of a person with the baby bottle being supported in a nursing position. The method of the present invention is comprised of the steps of inserting a baby bottle within the flexible and resilient annular opening of the first end of a tubular length of material. Then, the length of material is draped about the neck of a person holding an infant in one arm, and is positioned to support the baby bottle in a nursing position with respect to the infant. In one embodiment, the method further includes adjusting the length of the tubular member by bunching or removing the tubular member about or from the baby bottle.

These and other objects of the present invention will become apparent to those skilled in the art from the following detailed description, showing the contemplated novel construction, combination, and elements as herein described, and more particularly defined by the appended claims, it being understood that changes in the precise embodiments to the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments of the present invention according to the best modes presently devised for the practical application of the principles thereof, and in which.

DETAILED DESCRIPTION OF THE PREFERRED EMBODIMENTS

Figure 1:
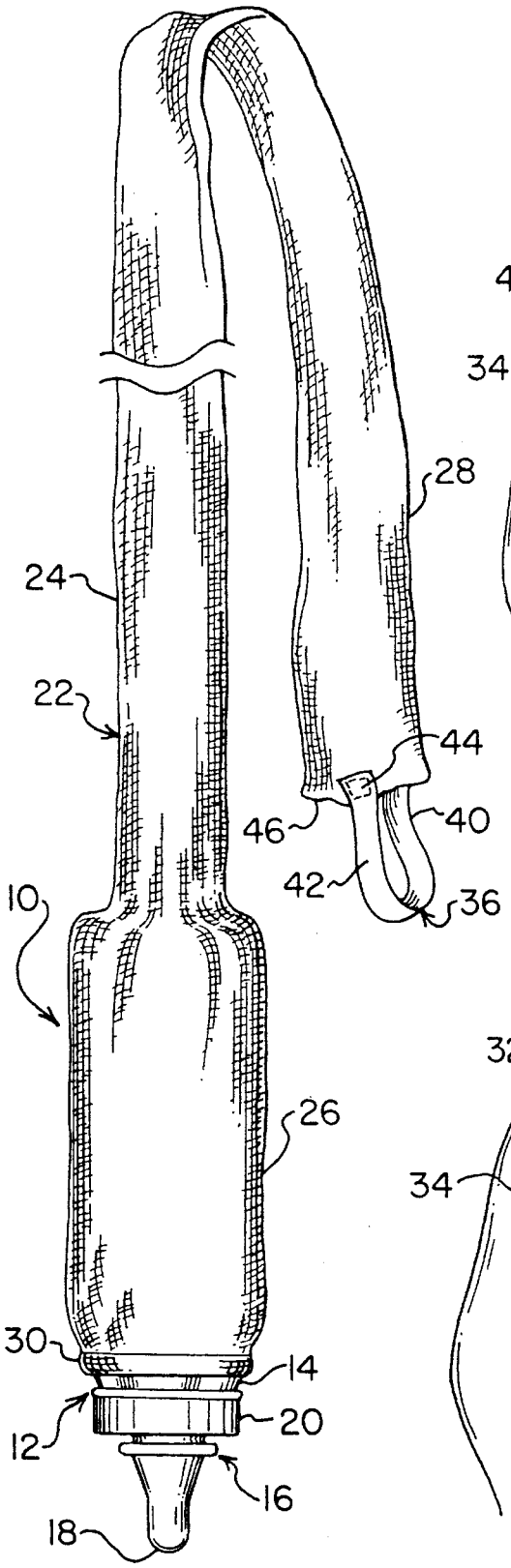
FIG. 1 is a side elevational view of the baby bottle holder of the present invention illustrating a baby bottle having a body portion and a neck portion with the body portion of the baby bottle being releasably secured within the baby bottle holder and further illustrating an end strap opposite the releasably secured baby bottle for grasping the neck of the baby bottle, or for carrying a baby accessory or toy.
Figure 2:
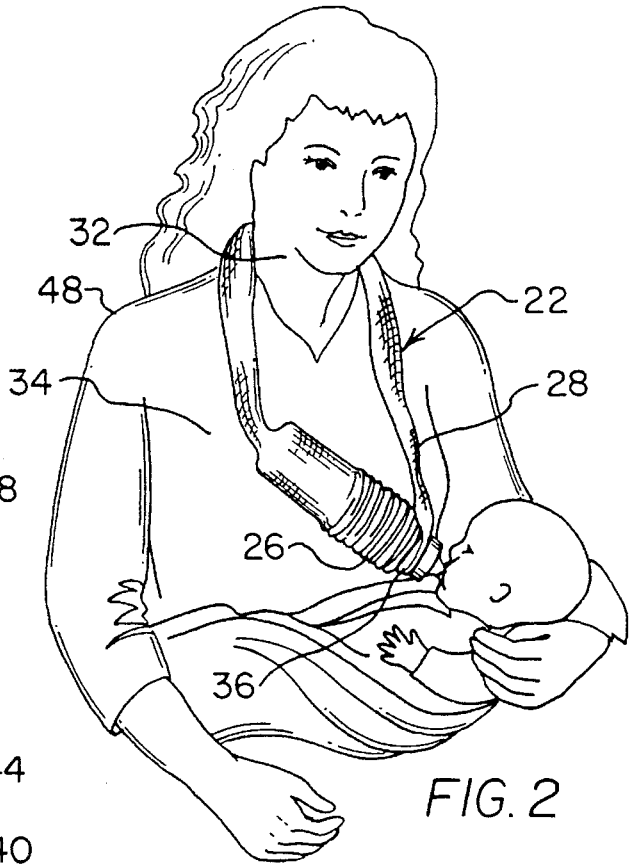
FIG. 2 is a perspective view of the baby bottle holder of the present invention illustrating the baby bottle holder being draped around the neck of a person feeding an infant with the baby bottle holder releasably securing the body of the baby bottle and an end strap around the neck of the baby bottle for securing the baby bottle in a nursing position.

As illustrated in FIG. 1, the present invention is a baby bottle holder, indicated generally at 10, for holding a baby bottle 12, in a nursing position, as illustrated in FIG. 2.

Typically, a baby bottle 12 includes a body portion (not visible), and a tapered neck portion 14 adjacent to the body portion. Neck portion 14 typically includes a threaded area (not visible), and a nipple assembly 16 releasably secured to the threaded area of neck portion 14. The body portion of the baby bottle 12 can be of a variety shapes, including a substantially cylindrical or polygonal body type. In other embodiments, the body portion is of the grip-type, i.e. it is capable of being gripped by an infant by one hand. Additionally, the body portion of the baby bottle 12 can be a variety of sizes, i.e., the traditional size of eight measured ounces or a smaller size, to accommodate specific infant appetites or liquids.

The nipple assembly 16 generally includes a nipple 18 and an annular, fluid-tight, threaded ring 20. The ring 20 surrounds at least a portion of the nipple 18 and is designed to be threaded to the threaded area of the neck portion 14 of baby bottle 12. In this manner, the nipple 18 is releasably secured to the neck portion 16 to provide a baby bottle 12 which is capable of carrying nursing liquids for use in feeding an infant.

The baby bottle holder 10 of the present invention comprises a length of flexible material 22. In preferred embodiments the length of flexible material 22 is a tube 24. In preferred embodiments flexible tube 24 is seamless. The actual length of the flexible material 22 can be varied, but should be a sufficient to allow it to be draped around the neck 32 of the largest potential person 34 who may use it to support and locate a baby bottle in a nursing position for an infant held in one arm of that person 34. A length of flexible material 22 of from about thirty to about forty inches has been found to be useful, with a length of about three feet being preferred.

The length of material 22 includes a first end portion 26 and a second end portion 28. First end portion 26 includes an annular opening 30, preferably of elastic, resilient material for releasably receiving the body portion of a baby bottle 12. The circumference of the unstretched annular opening 30 is preferably equal to or less than the circumference of the body portion of baby bottle 12. Thus, when baby bottle 12 is placed within annular opening 30 it is either force fit or gripped by annular opening 30, so that bottle 12 is maintained within the baby bottle holder 10 and is not easily dislodged.

In a preferred embodiment, the material 22, at least at annular opening 30, is comprised of an elastic, resilient cotton-Lycra polymer blend which will stretch around and releasably hold baby bottle 12. However, other elastic, resilient fabric is also within the scope of the present invention. Regardless of its composition, material 22 should be washable by conventional means, such as in a conventional washing machine, without any special laundering procedures or instructions.

As noted above, in preferred embodiments flexible tube 24 is seamless. One art known method is to produce a seamless tube by knitting the material 22 into a substantially tubular shape in much the same fashion as tube socks are manufactured. However, it is within the scope of the present invention to construct baby bottle holder 10 from material which has been sewn together with a seam along its length.

Figure 4:
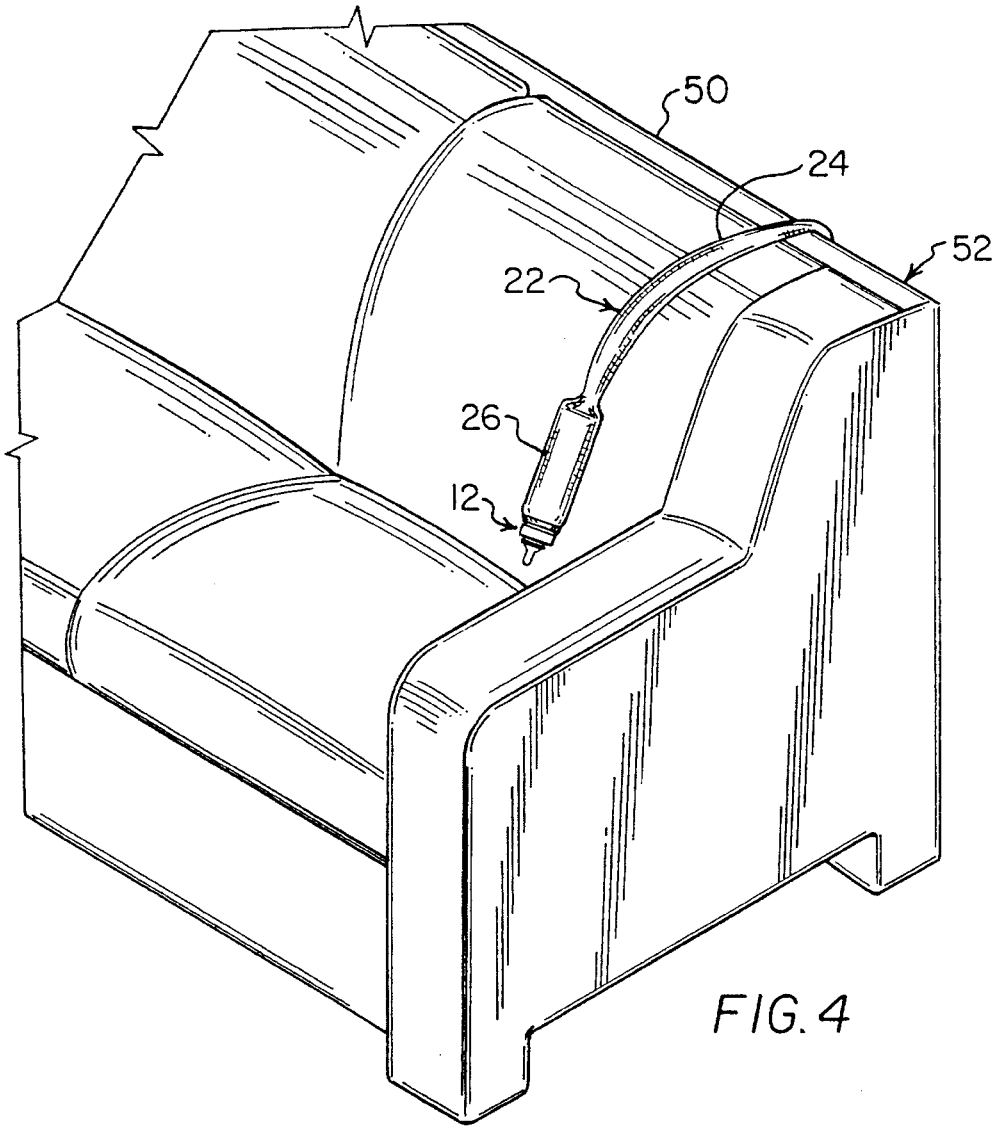
FIG. 4 is a perspective view of the baby bottle holder of the present invention illustrating the bottle holder draped over a back side of a piece of furniture, such as a sofa, with a clip or other fastener releasably securing the bottle in a nursing position.
Figure 5:
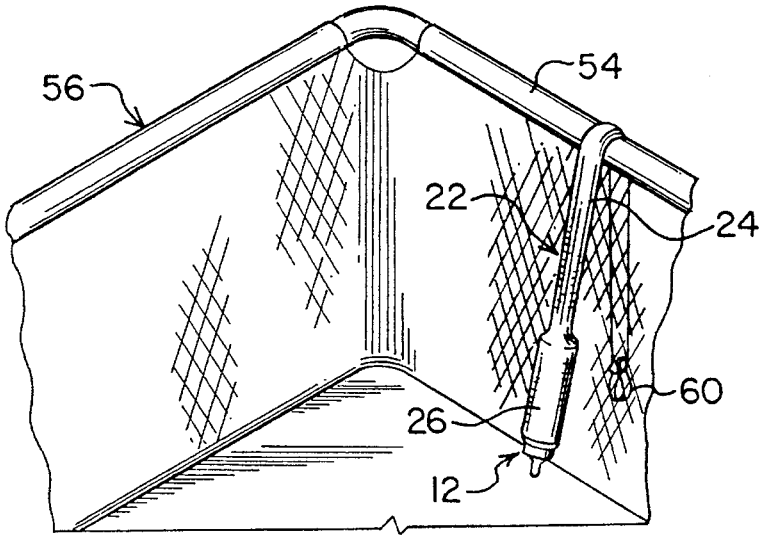
FIG. 5 is a perspective view of the baby bottle holder of the present invention illustrating the bottle holder draped over a side of a playpen.

As noted above, and as illustrated in FIG. 2, the length of material 22 should be sufficient to drape at least a portion of the material 22 around a neck 32 of a person 34 feeding the infant while being able to support the baby bottle 12 in a nursing position as shown. However, material 22 should have a length sufficient to hold baby bottle 12 in a nursing position when material 22 is draped, over a piece of furniture, such as back 50 of a sofa 52, as illustrated in FIG. 4, or, over a side wall 54 of a playpen 56, as illustrated in FIG. 5.

If the person 34 who is holding and feeding the infant discovers that the length of material 22 is too long or too short, so that the baby bottle 12 cannot be located in a proper nursing position, the height at which the length of material 22 holds baby bottle 12 can be adjusted. For example, a baby bottle 12 may be raised, i.e. the effective length of baby bottle holder 10 may be diminished, by bunching a portion of the length of material 22 about the body of the baby bottle. Similarly, a baby bottle 12 may be lowered, i.e. the effective length of the baby bottle holder 10 may be extended, by removing a portion of the length of material 22 which has been previously bunched about the body of the baby bottle. Bunching of material 22 around baby bottle 12 also provides a thicker cover around baby bottle 12, and thereby provides an improved insulating effect for maintaining the temperature of the contents of baby bottle 12. Bunching and removing bunched material 22 from baby bottle 12 is described in additional detail below.

Referring again to FIG. 1, baby bottle holder 10 of the present invention further includes an end strap 36. End strap 36 is sized and shaped to receive at least a portion of the neck portion 14 of baby bottle 12, as illustrated in FIG. 2. As shown in FIG. 1, end strap 36 includes a mounting end 40 and an attachment end 42 and is mounted at the second end portion 28 of the length of material 22. In preferred embodiments, mounting end 40 of end strap 36 is integrally formed, for example by knitting, into length of material 22 during construction of baby bottle holder 10. However, attachment end 42 of end strap 36 is designed to be releasably securable to second end portion 28 by a hook and loop fastening mechanism 44, such as Velcro, or by other fastening mechanisms such as snaps, buttons, hooks, or the like.

In the case of a tubular length of material 22, the end strap 36 is mounted such that the mounting end 40 is opposite the attachment end 42 and spans an annular opening 46 at second end portion 28 of the length of material 22. The reception of the baby bottle 12 or baby accessory 38 within the attached end strap 36 is described in greater detail below. While end strap 36 is preferably constructed simultaneously with and of the same material as length of material 22, it is within the scope of the present invention to construct end strap 36 from other material, such as ribbon, string, cloth, or the like, and to mechanically connect the first end of the strap to the second end of the length of material.

Figure 3:
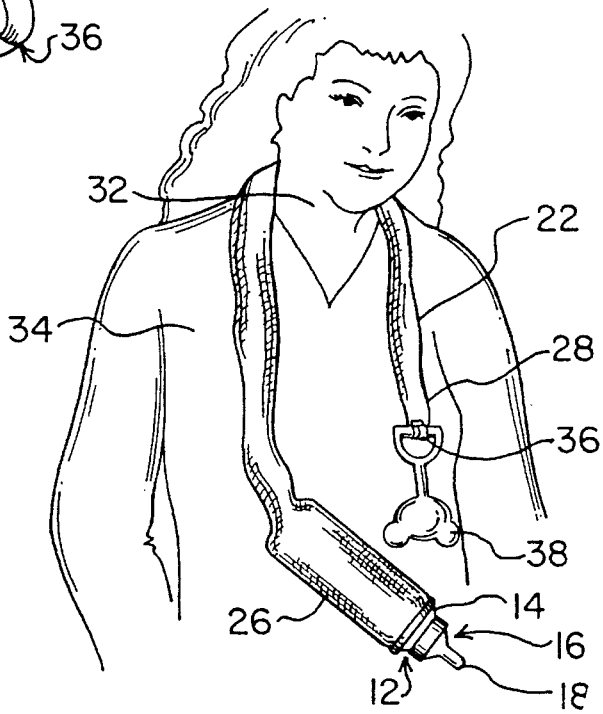
FIG. 3 is a perspective view of the baby bottle holder of the present invention illustrating the baby bottle holder draped around the neck of a person with the baby bottle holder releasably securing the body of the baby bottle and an end strap carrying a baby accessory or toy.

End strap 36 is also sized and shaped to secure a baby accessory or toy 38 such as a rattle or stuffed animal, as illustrated in FIG. 3, or to carry a clip 60, for example, to fasten holder 10 to a piece of furniture, such as sofa, as illustrated in FIG. 4.

In practice, to feed an infant using the baby bottle holder 10 of the present invention, according to the method of the present invention, the baby bottle 12 is prepared for the infant in the usual and customary manner with milk, formula, juice, water, or the like, with the liquid warmed or cooled to the desired temperature. The body portion of baby bottle 12 is then inserted into annular opening 30 of the first end portion 26 of the length of material 22 so that at least the nipple assembly 16 and the neck portion 14 of baby bottle 12, as illustrated in FIG. 2, extends from the length of material 22. This locates baby bottle 12 within holder 10 in a position which will provide an infant with easy access to the nipple 18. The size and design of annular opening 30, releasably secures the body portion of the baby bottle 12 within the length of material 22. In preferred embodiments, in which length of material 22 is flexible and resilient, annular opening 30 will constrict about the body portion of the baby bottle 12, and also about at least a portion of neck portion 14 of baby bottle 12.

Then, as illustrated in FIG. 2, the length of material 22 is draped around the neck 32 of the person 34 who will be holding and feeding the infant. Depending upon the size of the person 34 feeding the infant, the length of the baby bottle holder 10 may need to be adjusted to a position which is most comfortable to the infant and to the person 34 feeding the infant. As mentioned above, the length of the baby bottle holder 10 is adjustable by bunching and removing bunched material 22 about and from the body portion of the baby bottle 12. End strap 36 can then be attached about the neck portion 14 of the baby bottle 12 to support and position baby bottle 12 in a nursing position.

It is therefore seen that baby bottle holder 10 of the present invention, when properly used, will support baby bottle 12 in a nursing position such that baby bottle 12 can hang from the neck 32 or shoulders 48 of the person 34 while the person 34 holds and positions the infant in the proper feeding position. As illustrated in FIG. 1, the baby bottle holder 10 of the present invention will maintain the baby bottle 12 therewithin even when the baby bottle 12 is filled with liquid. Therefore, the person 34 can use both of his or her hands to safely and properly position the infant. Once the infant is finished with baby bottle 12, both hands of the user 34 can be used to place the infant in a safe place while the baby bottle holder 10 and baby bottle 12 are removed from user 34.

The baby bottle holder 10 of the present invention positions the baby bottle 12 in a nursing position which simulates the position a mother holds a child while breast feeding. Nature allows a mother to have one free hand while breast feeding since there are no baby bottles to hold. The baby bottle holder 10 of the present invention is soft and allows the baby bottle 12 to lay naturally across the chest of the person feeding the infant. Additionally, the length of material 22 provides a warm, soft fabric around the baby bottle 12 for the infant to grasp rather than cold hard glass or plastic.

If desired, as illustrated in FIG. 3, end strap 36 can be attached to a toy or baby accessory 38, such as a pacifier, for easy accessibility by an infant during infant feeding, or at other times. Additionally, material 22 has a length which is sufficient to hold baby bottle 12 in a nursing position when material 22 is draped, over a piece of furniture, such as the back 50 of a sofa 52, as illustrated in FIG. 4, or, over a side wall 54 of a playpen 56, as illustrated in FIG. 5.

The baby bottle holder 10 of the present invention may be packaged in a kit which includes the baby bottle holder 10, a baby accessory, such as a rattle 38 and/or pacifier, and a clip 60 to fasten holder 10 to a piece of furniture, all of which kit parts are shown in the various illustrations. Packaging the baby bottle holder 10 in such a fashion in a kit offers the ultimate user a total baby package for convenience of use.

It is therefore seen that the present invention provides a baby bottle holder 10 which can be used by a person 34 holding an infant in one arm, to support a baby bottle 12 in a depending manner from the neck 32 of such a person 34, while freeing the other arm and hand of such a person. It is further seen that the present invention provides such a baby bottle holder 10 which has easily adjustable dimensions, thereby allowing it to be adjusted to fit an assortment of persons 34 of different sizes who may hold and feed an infant while using baby bottle holder 10. It is further seen that the present invention provides a baby bottle holder 10 formed from a length of material 22 which can be draped around the neck 32 of a person 34 who is holding an infant while releasably securing a baby bottle 12 in a nursing position. It is also seen that the present invention teaches a kit which includes the baby bottle holder of the present invention, a baby accessory, such as a rattle or pacifier, and a clip for use in fastening the baby bottle holder to a piece of furniture.

The foregoing exemplary descriptions and the illustrative preferred embodiments of the present invention have been explained in the drawings and described in detail, with varying modifications and alternative embodiments being taught. While the invention has been so shown, described and illustrated, it should be understood by those skilled in the art that equivalent changes in form and detail may be made therein without departing from the true spirit and scope of the invention, and that the scope of the present invention is to be limited only to the claims except as precluded by the prior art. Moreover, the invention as disclosed herein, may be suitably practiced in the absence of the specific elements which are disclosed herein.

We claim:

1. A baby bottle holder for use by a person holding an infant in one arm, which baby bottle holder will support a baby bottle having a body portion and a neck portion in a nursing position, the baby bottle holder comprising:

a length of flexible tubular material having a first end and a second end, said first end being in the form of a flexible tubular member, said first end tubular member defining an annular open end portion which is sized and designed to releasably receive and secure the body portion of a baby bottle, the length of said material being sufficient to drape the material around the neck of a person holding an infant in one arm while supporting any baby bottle which has been releasably received and secured in said annular open first end in a nursing position.

2. The holder of claim 1 wherein said annular open portion includes a resilient portion to releasably secure the body portion of a baby bottle within said annular open portion of said tubular member.

3. The holder of claim 1 wherein said flexible tubular member is seamless.

4. The holder of claim 1 wherein said length of material includes an expandable material.

5. The holder of claim 4 wherein said expandable material included in said length of material includes a stretchable polymer.

6. The holder of claim 1 wherein said second end of said length of material carries a support means which is designed and dimensioned to be received around and hold the neck of any baby bottle which has been releasably received and secured in said annular open first end in a nursing position.

7. The holder of claim 6 wherein said support means includes a strap having a mounting end and an attaching end, said mounting end being secured to said second end of said length of material, and said attaching end being releasably attached to said second end of said length of material.

8. The holder of claim 7 wherein said mounting end of said strap is integrally formed at said second end of said length of material.

9. The holder of claim 6 wherein said mounting end of said strap is mounted to said second end of said length of material by mechanically connecting said mounting end of said strap to said second end of said length of material.

10. The holder of claim 6 wherein said attaching end of said strap is releasably attached to said second end of said length of material.

* * * * *